US008264146B2

(12) United States Patent
Kuromiya et al.

(10) Patent No.: US 8,264,146 B2
(45) Date of Patent: Sep. 11, 2012

(54) PLASMA DISPLAY PANEL AND METHOD FOR PRODUCING THE SAME

(75) Inventors: Michiru Kuromiya, Osaka (JP); Shuzo Tsuchida, Nara (JP); Tomohiro Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/026,324

(22) Filed: Feb. 14, 2011

(65) Prior Publication Data

US 2011/0198986 A1 Aug. 18, 2011

(30) Foreign Application Priority Data

Feb. 15, 2010 (JP) ..... P 2010-030294

(51) Int. Cl.
*H01J 17/49* (2006.01)

(52) U.S. Cl. ..... 313/586; 445/24; 313/582; 313/583

(58) Field of Classification Search ..... 313/582–587; 345/37, 41, 60, 71; 427/508, 554
See application file for complete search history.

(56) References Cited

U.S. PATENT DOCUMENTS

2002/0089285 A1* 7/2002 Nishiki et al. ..... 313/583
2007/0065667 A1* 3/2007 Fukushima ..... 428/411.1
2008/0272684 A1* 11/2008 Horikawa et al. ..... 313/492
2008/0278055 A1 11/2008 Yamashita et al.
2009/0053483 A1 2/2009 Ito et al.
2010/0039034 A1 2/2010 Ito et al.
2010/0244659 A1 9/2010 Takagi et al.

FOREIGN PATENT DOCUMENTS

| | | |
|---|---|---|
| JP | 2005-149987 | 6/2005 |
| JP | 2006-148082 | * 6/2006 |
| JP | 2008-282707 | 11/2008 |
| JP | 2008-293867 | 12/2008 |
| WO | 2007/123270 | 11/2007 |

* cited by examiner

*Primary Examiner* — Mariceli Santiago
*Assistant Examiner* — Donald Raleigh
(74) *Attorney, Agent, or Firm* — Wenderoth, Lind & Ponack, LLP.

(57) ABSTRACT

A plasma display panel includes a front panel wherein an electrode, a dielectric layer and a protective layer are formed on a substrate of the front panel; and a rear panel wherein an electrode, a dielectric layer and a barrier rib and a phosphor layer are formed on a substrate of the rear panel. The front panel and the rear panel are oppositely disposed to each other. The electrode of the front panel is composed of a transparent electrode and a bus electrode, and the bus electrode comprises a melted-solidified portion obtained by a melting and subsequent solidifying of electrically-conductive particles.

4 Claims, 6 Drawing Sheets

PLASMA DISPLAY PANEL AND METHOD FOR PRODUCING THE SAME

FIELD OF THE INVENTION

The present invention relates to a method for producing a plasma display panel. In particular, the present invention relates to a method for producing an electrode on the front panel side of the plasma display panel. The present invention also relates to a plasma display panel obtained by such a method.

BACKGROUND OF THE INVENTION

A PDP (for example, a three electrode surface discharge type PDP) has a structure in which a front panel that forms a surface side as viewed by a person who takes a look at an image, and a rear panel are oppositely disposed to each other, the peripheries of the front panel and the rear panel being sealed by a sealing material. Between the front panel and the rear panel, there is formed a discharge space filled with a discharge gas (neon, xenon or the like). The front panel is provided with a glass substrate, a display electrode pair comprising a scan electrode and a sustain electrode formed on one surface of the glass substrate, and a dielectric layer and a protective layer that cover these electrodes. The rear panel is provided with a plurality of address electrodes formed on the glass substrate in the form of stripes in a direction that perpendicularly intersects to the display electrode pair, a base dielectric layer that covers the address electrodes, barrier ribs serving to partition the discharge space with respect to every address electrode, and phosphor layers (red, green and blue fluorescent layers) coated on the base dielectric layer and the sides of the barrier ribs.

The display electrode pair and the address electrode perpendicularly intersect to each other, and each intersection portion thereof serves as a discharge cell. These discharge cells are arranged in the form of a matrix, and three discharge cells having red, green and blue fluorescent layers, arranged in the direction of the display electrode pair, serve as picture elements for color display. In the PDP, a predetermined voltage is sequentially applied between the scan electrode and the address electrodes, and between the scan electrode and the sustain electrode to generate gas discharge. Then, the phosphor layers are excited by ultraviolet rays generated by the gas discharge, and thereby emitting visible lights, which leads to a realization of a full-color display.

Significant progress has recently been made in realization of higher definition of PDP to a high definition television in which the number of scanning lines is two or more times larger than an NTSC system of the prior art. At the same time, with the progress of a display with a larger screen, voltage and electric power required to display images necessarily increase, and thus it is required to decrease a resistance value of the display electrode.

In order to decrease the resistance value of the display electrode, the cross-sectional area of the electrode must be increased. However, when the electrode width is increased, an aperture area, through which visible lights of picture elements to be image-displayed is transmitted, becomes smaller, leading to a decrease in an image display brightness of the PDP. In contrast, when the thickness of the electrode increases, there arises a problem that the thickness of the dielectric layer provided on the electrode substantially becomes smaller, leading to a decrease in a dielectric strength voltage.

Therefore, a trial has been conducted of increasing an amount of thermal shrinkage of a metal bus electrode attributable to a heat history of the calcining step as the step after the development to densely form an electrode film, by increasing an amount of a so-called "undercut" of the bus electrode after the development, namely, by controlling the value of a difference between a projection width W2 of bus electrodes (12*b*, 13*b*) to 25 μm or more and a width W1 being in contact with the substrate of the bus electrodes (12*b*, 13*b*) as shown in FIG. 7. Whereby, the contact points between silver particles can be increased, thus making it possible to improve an electric conductivity of the bus electrode (see Literature 1 described below, for example).

For example, literature disclosing the conventional PDP producing method are as follows:

Literature 1: JP-A-2008-293867

Literature 2: JP-A-2008-282707

As a result of increasing the contact points between silver particles (silver powders) by densifying the electrode film, the electric conductivity between the particles can be increased. However, since silver particles are merely in point contact with each other even after calcining, a decrease in the resistance value is still small even in the case of the dense film. Furthermore, when the amount of the undercut increases, the amount of a warp (amount of "edge curl") of the end of the bus electrode increases, the warp amount being generated by a difference in a thermal shrinkage between the white layer and the black layer. Namely, as shown in FIG. 8, a value of a difference between "film thickness H1 at the center in a width direction of bus electrodes (12*b*, 13*b*)" and "film thickness H2 at the end of bus electrodes (12*b*, 13*b*)" increases. As a result, a substantial film thickness of the dielectric layer around the edge curl decreases, and thereby a dielectric strength voltage decreases (see FIG. 9 regarding "edge curl", and also see the above Literature 2 regarding a generation of "edge curl"). In particular, in a case in which the dielectric layer is formed from a sol-gel material, a level-difference is generated in a surface of the dielectric layer due to an increase in the amount of the edge curl and thus cracking is likely to generate in the dielectric layer, which causes a risk of a decrease in the dielectric strength voltage.

Under the above circumstances, the present invention has been created. Thus, an object of the present invention is to provide a PDP with a decreased resistance of the bus electrode, and another object thereof is to provide a PDP with a suppressed edge curl of the bus electrode.

SUMMARY OF THE INVENTION

In order to achieve the above objects, the present invention provides a method for producing a plasma display panel comprising a front panel wherein an electrode, a dielectric layer and a protective layer are formed on a substrate of the front panel, the electrode of the front panel being composed of a transparent electrode and a bus electrode;

a formation of the bus electrode comprising:

(i) preparing a bus-electrode material which comprises electrically-conductive particles;

(ii) supplying the bus-electrode material onto the transparent electrode formed on the substrate;

(iii) heating the bus-electrode material to form the bus electrode therefrom; and (iv) heating the surface of the bus electrode as a local heat treatment to allow at least one of the electrically-conductive particles contained in the bus electrode to melt.

The production method of the present invention is characterized by subjecting the obtained bus electrode to the local heat treatment. Particularly as for the production method of the present invention, the surface of the obtained bus electrode is subjected to the local heat treatment, and thereby melting at least one of the electrically-conductive particles contained in the bus electrode.

As used in claims and specification of the present invention, the phrase "local heat treatment" means the heating of a part of the bus electrode (particularly the heating of the bus electrode to a limited depth from the surface thereof), not the heating of the entire bus electrode. In a particularly preferred embodiment, the surface of the bus electrode is subjected to a heat treatment by subjecting the bus electrode to a rapid thermal heat treatment. Such heat treatment enables a melting of the at least one of the electrically-conductive particles contained in the bus electrode (particularly it enables a melting of the electrically-conductive particles existing in the vicinity of the surface of the bus electrode). The bus electrode thus obtained can exhibit a lower resistance since it includes the region or portion formed by melting and subsequently solidifying the at least one of the electrically-conductive particles contained therein. For instance, the resistance value of the bus electrode decreases by about 5% to about 50% as compared with the case where the above "local heat treatment" is not performed.

As used in this specification and claims, the phrase "front panel" refers to a PDP panel disposed on the front side facing the viewer, and thus substantially means a PDP panel disposed on the side where the phosphor layer and barrier ribs are not provided. In other words, the front panel is a PDP panel disposed to oppose a rear panel whereon the phosphor layer and the barrier ribs are provided.

In a preferred embodiment, the electrically-conductive particles existing in the inner region of the bus electrode in a depth of 0.2 t to 0.7 t from the surface of the bus electrode are melted (t: the entire thickness of the bus electrode). In other words, the only electrically-conductive particles contained from the surface of the bus electrode to the limited depth accounting for 20% to 70% of the entire thickness of the bus electrode are melted by the heating of the step (iv).

In another preferred embodiment, a plasma torch, a laser or a flash lamp is used as a means for performing the local heat treatment.

The present invention also provides a plasma display panel obtained by the production method described above. Such plasma display panel comprises:

a front panel wherein an electrode, a dielectric layer and a protective layer are formed on a substrate of the front panel; and a rear panel wherein an electrode, a dielectric layer and a barrier rib and a phosphor layer are formed on a substrate of the rear panel;

the front panel and the rear panel being oppositely disposed to each other;

wherein the electrode of the front panel is composed of a transparent electrode and a bus electrode; and the bus electrode comprises a melted-solidified portion obtained by a melting and subsequent solidifying of electrically-conductive particles.

The phrase "melted-solidified portion" as used in this specification and claims substantially means a part of the bus electrode, the part of which is provided by once melting and subsequently solidifying the electrically-conductive particles of the bus electrode material. Such "melted-solidified portion" is not limited to that in which all electrically-conductive particles in this portion have been melted and subsequently solidified, and thus may be that in which some of non-melted-solidified electrically-conductive particles are partially included in this portion. Moreover, such "melted-solidified portion" is not limited to that in which the electrically-conductive particles have been completely melted and subsequently solidified, and thus may be that in which the electrically-conductive particles have been incompletely melted and subsequently solidified (for instance, the only electrically-conductive particles existing in the close vicinity of the surface of the bus electrode have been completely melted and subsequently solidified).

In the plasma display panel of the present invention, the melted-solidified portion is provided in the vicinity of the surface of the bus electrode. Specifically, the melted-solidified portion extends from the surface of the bus electrode to a limited depth of the bus electrode. This means that the melted-solidified portion forms a surface layer of the bus electrode. In a preferred embodiment, the melted-solidified portion has thickness (i.e. depth dimension) in the rage of 0.2 t to 0.7 t from the bus electrode surface (t: the entire thickness of the bus electrode).

In another preferred embodiment, the bus electrode has a two-layered structure composed of a black layer and a white layer wherein the black layer is in contact with the transparent electrode and the white layer is provided on the black layer. In this embodiment, the black layer preferably comprises a glass material having a softening temperature of 400° C. to 550° C.

In the plasma display panel according to the present invention, the bus electrode includes the "melted-solidified portion derived from the electrically-conductive particles", and thus the bus electrode exhibits a low resistance on the whole (specifically, the bus electrode has a lower resistance value which is decreased by about 5% to about 50% as compared with the case of no "local heat treatment" being performed). As a result, a PDP with a lower power consumption is realized in the present invention. Particularly, the melted-solidified portion of the electrically-conductive particles exists on the surface side of the bus electrode, and this means that the resistance value of the white layer (i.e. the white layer of the bus electrode) contributing to a discharge can decrease. Therefore, much current can flow in the white layer, which is more likely to cause the discharge, thus realizing a PDP with the lower power consumption.

The present invention also makes it possible to remove or reduce "edge curl" of the bus electrode by "local heat treatment". Accordingly the present invention can avoid a lower dielectric strength voltage of the dielectric layer. In other words, the removing or reduction of the edge curl of the bus electrode according to the present invention means that the occurrence of a cracking caused by "edge curl" can be effectively prevented even when the dielectric layer is formed by a sol-gel process, which leads to an effective avoidance of the decrease in the dielectric strength voltage.

BRIEF DESCRIPTION OF THE DRAWINGS

FIG. 5(*a*): a sectional micrograph of the bus electrode before a PTA treatment, and FIG. 5(*b*): a sectional micrograph of the bus electrode after the PTA treatment.

DETAILED DESCRIPTION OF THE INVENTION

Figure 1:
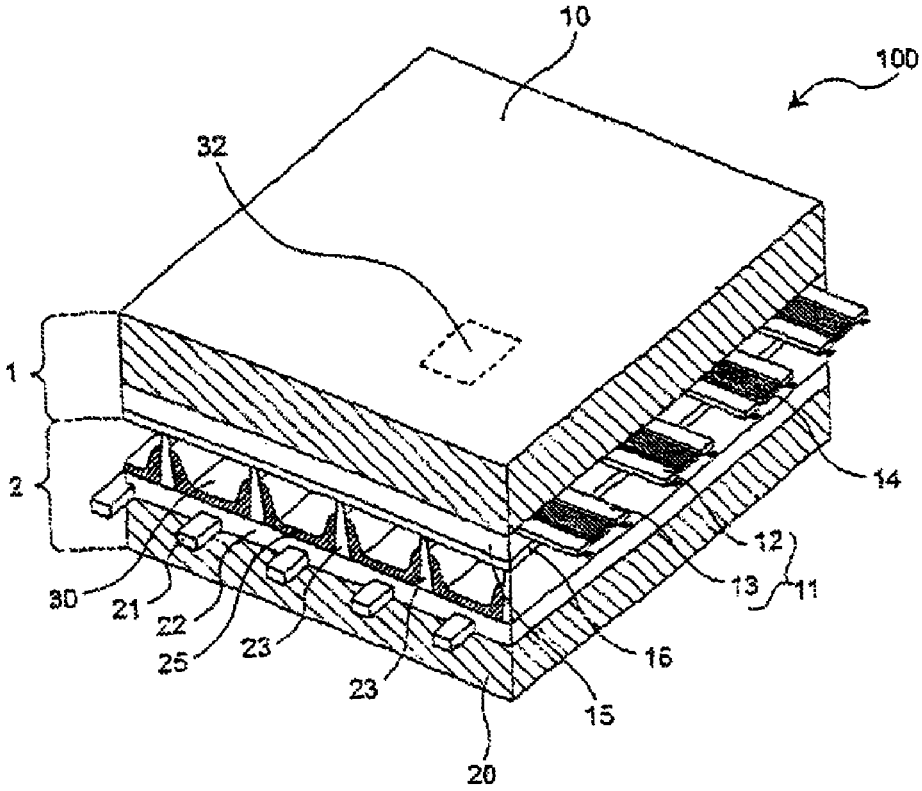
FIG. 1 is a perspective view schematically showing a structure of a PDP.

With reference to the accompanying drawings, a method for producing a plasma display panel as well as the plasma display panel according to the present invention will be described in detail. Various components or elements in the drawings are shown schematically with dimensional proportions and appearances that are not necessarily real, which are merely for the purpose of making it easy to understand the present invention.

[Construction of Plasma Display Panel]

Figure 2:
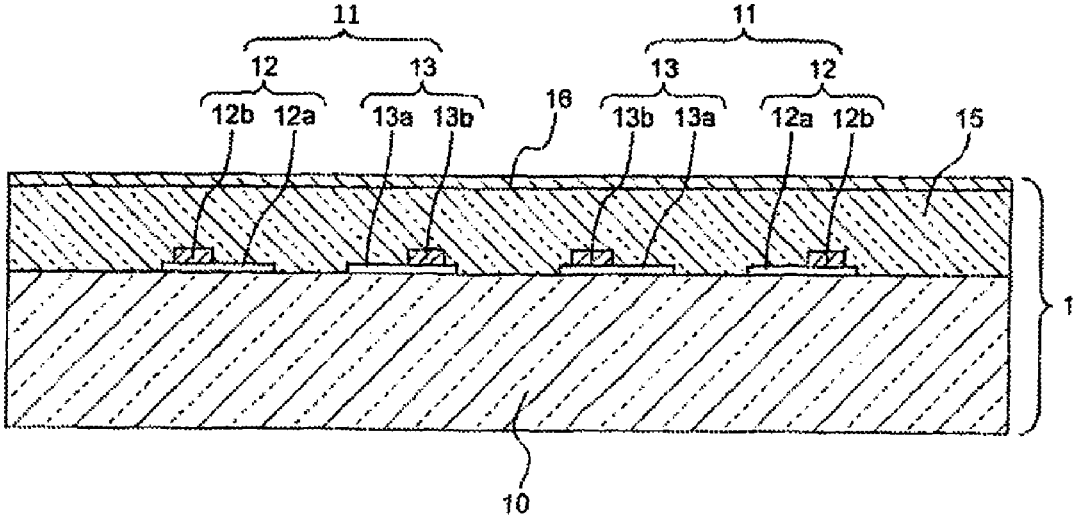
FIG. 2 is a sectional view schematically showing a structure of a PDP front panel.
Figure 3A:
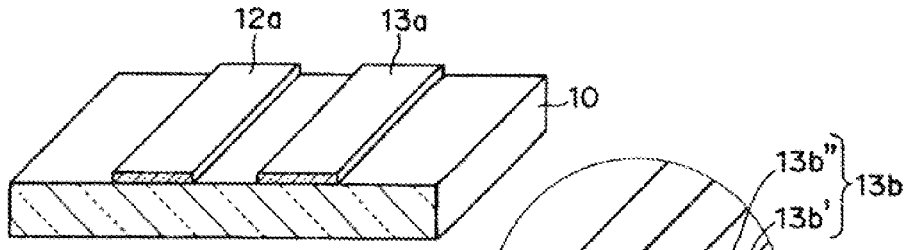
FIGS. 3(*a*)-3(*e*) are perspective sectional views schematically showing the steps in a method of the present invention.
Figure 3B:
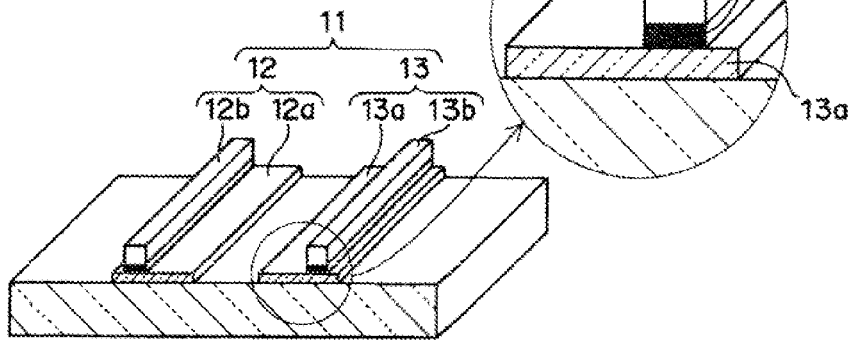
Figure 3C:
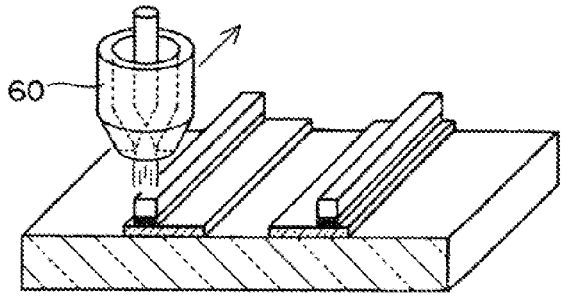
Figure 3D:
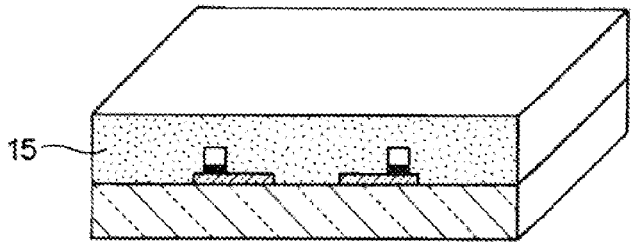
Figure 3E:
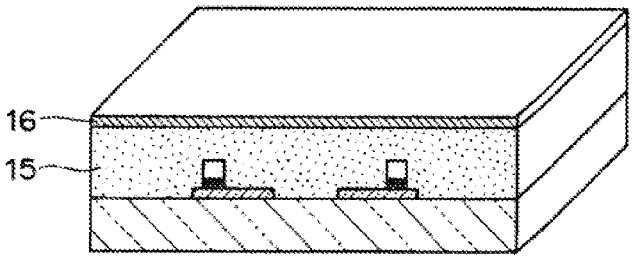

First, a plasma display panel (hereinafter also referred to as a "PDP"), which can be finally obtained by the method of the present invention, is described below. FIG. 1 shows a perspective sectional view of the entire constitution of the PDP, and FIG. 2 shows a sectional view of the constitution of a front panel of the PDP.

In a front panel (1) of a PDP (100), a plurality of display electrodes (11), each being composed of a scan electrode (12) and a sustain electrode (13), are formed on a smooth, transparent and insulating substrate (10) (e.g. a glass substrate). A dielectric layer (15) is formed so as to cover the display electrodes (11). Furthermore, on the dielectric layer (15), a protective layer (16) (e.g. a protective layer made of MgO) is formed. Particularly, the display electrodes (11) are constituted, as shown in FIG. 2, by including a plurality of electrode pairs (11), each composed of a transparent electrode (12*a*/13*a*) and a bus electrode (12*b*/13*b*). The transparent electrodes (12*a*, 13*a*) are transparent conductive films made of indium oxide (ITO), tin oxide ($SnO_2$) or the like. The transparent electrode preferably has a thickness dimension of about 50 to 500 nm. While on the other hand, the bus electrodes (12*b*, 13*b*) are electrodes containing silver as a main component. The bus electrode preferably has a thickness dimension of 1 to 55 μm, and more preferably 1 to 20 μm, and also preferably has a width dimension of 10 to 200 μm, and more preferably 50 to 120 μm.

In a rear panel (2) that is disposed oppositely to the front panel (1), a plurality of address electrodes (21) are formed on an insulating substrate (20). A dielectric layer (22) is formed so as to cover the address electrodes (21) of the rear panel (2). Barrier ribs (23) are provided on the dielectric layer (22) and at the corresponding position between the address electrodes (21). Red, green and blue fluorescent layers (25) are respectively provided between adjacent barrier ribs (23) on the surface of the dielectric layer (22).

In order to allow the display electrodes (11) and the address electrodes (21) to perpendicularly intersect to each other and to form a discharge space (30), the front panel (1) and the rear panel (2) are oppositely disposed to each other while interposing the barrier ribs (23) therebetween. The discharge space (30) is filled with a rare gas such as helium, neon, argon or xenon as a discharge gas. In the PDP (100) thus constituted, the discharge space (30) is partitioned by the barrier ribs (23), and each of the partitioned spaces positioned at a point of the intersection between the display electrode (11) and the address electrode (21) can function as a discharge cell (32).

[General Method for Production of PDP]

A typical method for producing such a PDP (100) will be briefly described below. The production of the PDP (100) includes the step of forming a front panel (1) and the step of forming a rear panel (2). As for the step of forming the front panel (1), on a glass substrate (10), transparent electrodes are formed by a sputter process or the like and then bus electrodes are formed by a calcining process or the like to form display electrode (11). Next, a dielectric material is applied over the glass substrate (10) so as to cover the display electrode (11), followed by a heat treatment thereof to from a dielectric layer (15). Next, a protective layer (16) is formed on the dielectric layer (15). Specifically, a film such as an MgO film is provided by performing an electron-beam deposition process (i.e. EB evaporation process), and thereby the front panel (1) is finally obtained.

As for the step of forming the rear panel (2), address electrodes (21) are formed on a glass substrate (20) by performing a calcining process or the like. Subsequently, a dielectric material is applied over the glass substrate so as to cover the address electrode, followed by a heat treatment thereof to form a dielectric layer (22). Next, barrier ribs (23) made of a low melting point glass are formed in a predetermined pattern. A phosphor material is applied between the barrier ribs (23) and then calcined to form a phosphor layer (25) therefrom. Subsequent to the formation of the phosphor layer (25), a panel sealing material which contains a low melting point frit glass material or the like is applied onto the periphery of the substrate and then calcined to form a sealing component therefrom (not shown in FIG. 1), and thereby the rear panel (2) is finally obtained. After the front and rear panels are obtained, a so-called panel sealing step is performed. Specifically, the front panel (1) and rear panel (2) are disposed opposed to each other and then heated in their fixed state to soften the sealing component therebetween. Such sealing step enables the front panel and the rear panel to be air-tight bonded with each other by the sealing component. After the sealing step, the discharge space (30) is vacuumed during heating thereof, followed by a filling of the discharge space (30) with the discharge gas (for instance, under a pressure condition of about 53000 Pa to about 80000 Pa). In this way, the PDP (100) is finally obtained.

[Production Method of the Present Invention]

The method of the present invention particularly relates to a formation of the bus electrode of the front panel in the PDP production. In the formation of the bus electrodes, the surface of the bus electrode formed preliminarily is subjected to a local heat treatment. Namely, when the bus electrode is formed according to the production method of the present invention, the whole of bus electrode precursor layer is subjected to a heat treatment and then a portion of the bus electrode thus obtained is subjected to the local heat treatment.

With reference to FIG. 3, some embodiments of the present invention will be described. First, as shown in FIG. 3(*a*), transparent electrodes (12*a*, 13*a*) are formed on a substrate (10). The substrate (10) is preferably an insulating substrate made of soda lime glass, high strain point glass or various ceramics, and the thickness thereof is preferably in the range of about 1.0 mm to about 3 mm. Transparent electrodes made of indium oxide (ITO), tin oxide ($SnO_2$) or the like are formed by performing a thin film process, a photography method or the like to the substrate (10). The thickness of the transparent electrodes is preferably in the range of about 50 nm to about 500 nm.

On the transparent electrodes (12*a*, 13*a*), bus electrodes (12*b*, 13*b*) are formed as shown in FIG. 3(*b*). Typically, a bus electrode material is applied, and then patterned using a photography process and finally calcined at a temperature of about 500° C. to about 600° C. to form the bus electrodes (12*b*, 13*b*). The bus electrode material is an electrode material paste that contains electrically-conductive particles (for instance, silver particles). Particularly in the present invention, as shown in FIG. 3(*b*), the bus electrodes are preferably formed in a two-layered structure composed of "black layer (13*b*') serving as a lower layer" and "white layer (13*b*") serving as an upper layer".

The formation of the bus electrode will be serially described. First, electrode material pastes of black layer and white layer used as the bus electrode material are respectively applied and then dried to form electrode precursor films. Specifically, a black layer material paste is applied on a transparent electrode and then dried to form a precursor film of the black layer, and subsequently a white layer material paste is applied on the surface of the precursor film of the black layer and then dried to form a precursor film of the while layer. Next, the surface of the electrode precursor films is exposed by irradiating with light while shielding the light by the use of a mask having a desired pattern. After exposure, the electrode precursor films are developed. After the development, the electrode precursor films are subjected to a calcining process, and thereby bus electrode is formed therefrom.

Both of the electrode material pastes for the black layer and the white layer are photosensitive pastes and are not particularly limited as long as they are usually used in the general production of the PDP. For instance, each of electrode material pastes for the black layer and the white layer contains electrically-conductive particles, glass frits, black inorganic fine particles, resins of organic substances (e.g. a photosensitive resin and an organic binder), a polymerization initiator, a monomer and/or an organic solvent and the like. The electrically-conductive particles are mainly contained in the electrode material paste for the white layer, whereas the black inorganic fine particles are mainly contained in the electrode material paste for the black layer. If necessary, the electrode material pastes for the white layer and the black layer may contain black inorganic fine particles and electrically-conductive particles, respectively, unless an adverse influence is exerted on their functions.

Such electrode material pastes are respectively applied using a roll coater or the like, and then most of the organic solvents thereof are respectively vaporized by drying them. As a result, each of the electrode precursor films after drying can contain the electrically-conductive particles, the glass frits, the resins of the organic substances such as the photosensitive resin and the organic binder (including those obtained through a polymerization of the monomer), the monomer and the like, excluding the vaporized organic solvents.

It is preferred that the electrode precursor film of the black layer is formed so as to have a thickness of about 0.5 μm to about 5 μm after the calcining thereof (i.e. the thickness of the black layer of the bus electrode may be preferably in the range of about 0.5 μm to about 5 μm). While on the other hand, it is preferred that the electrode precursor film of the white layer is formed so as to have a thickness of about 0.5 μm to about 50 μm after the calcining thereof (i.e. the thickness of the white layer of the bus electrode may be preferably in the range of about 0.5 μm to about 50 μm). If suitably ensuring an accuracy of the electrode width upon patterning the precursor film by the development is made much account, then the thickness of each of the black layer and the white layer is preferably in the range of about 0.5 μm to about 10 μm.

The method for applying the electrode material paste is not limited to a roll coating method, and thus it is possible to use a die coating method, a spin coating method, a blade coating method or the like.

Specific examples of the electrode material paste include those obtained by respectively mixing electrically-conductive particles such as silver (Ag) particles, glass frits containing bismuth oxide ($Bi_2O_3$), boron oxide ($B_2O_3$) and/or silicon oxide ($SiO_2$) as main components, a polymerization initiator, resins of organic substances, such as a photosensitive resin and an organic binder, a monomer and an organic solvent in a predetermined ratio. The respective components are described below.

As the electrically-conductive particles, it is preferable to use silver particles (Ag particles) with a particle size of about 0.1 μm to about 50 μm. In this regard, when the particle size of silver particles is less than 0.1 μm, an aggregation is likely to occur between silver particles and the resistance value of the resulting bus electrode may not become constant. While on the other hand, when the particle size of silver particles is more than 50 μm, such particle size becomes more than the height of the bus electrode, thus making it impossible to form a bus electrode with a constant and uniform pattern. As used herein, the term "particle size" substantially means a maximum particle length selected among particle lengths in any directions of the particle. As the electrically-conductive particles, not only the silver particles, but also particles of metal selected from the group consisting of aluminum (Al), nickel (Ni), gold (Au), platinum (Pt), chromium (Cr), copper (Cu) and palladium (Pd) each having satisfactory conductivity, or particles made of alloys thereof may be used. The silver particles or the electrically-conductive particles described above may be contained in the black layer (i.e. black layer material paste), but preferably may be contained in the white layer (i.e. electrode material paste for white layer).

As the glass frits, it is preferable to use a low melting point glass frits that mainly consist of bismuth oxide ($Bi_2O_3$), boron oxide ($B_2O_3$) and/or silicon oxide ($SiO_2$) and the like. In fact, the glass frits are not limited to the above glass frits as long as they are glass materials capable of forming a desired electrode shape, and thus other suitable glass frits may also be used.

The black inorganic fine particles will be now described. The black inorganic fine particles are mainly contained in the black layer (i.e. electrode material paste for black layer). Alternatively, the black inorganic fine particles may be contained in the white layer (i.e. electrode material paste for white layer). As the black inorganic fine particles, it is preferable to use particles of tricobalt tetraoxide ($Co_3O_4$). In a case where the tricobalt tetraoxide particles are used as the black inorganic fine particles, a dense calcined film having sufficient blackness is obtained even when a small amount of tricobalt tetraoxide particles are used, and thus sufficient contrast can be achieved with a thin film thickness. As a result, it is possible to form a calcined film (especially a film of the black layer) that can simultaneously satisfy sufficient interlayer conductivity (interlayer continuity between a transparent electrode and a white layer) and blackness after calcining without impairing an excellent adhesion to the substrate, a resolution and a calcining property in the respective steps of drying, exposure, development and calcining. Since the tricobalt tetraoxide has a high affinity with a polymerization initiator, a photosensitive resin, an organic component, an organic solvent and the like, an electrode material paste having an excellent storage stability can be obtained by using the tricobalt tetraoxide in combination with these organic component and organic solvent.

As the tricobalt tetraoxide particles, it is preferable to use fine particles with a particle size of 5 μm or less (preferably a particle size ranging from 0.05 μm to 5 μm). The particle size of 5 μm or less can produce a dense calcined film without impairing an adhesion of the film even when a small amount of the tricobalt tetraoxide particles are used. Particularly in the case of the black layer, the $Co_3O_4$ particle size of 5 μm or less can satisfy not only a sufficient an electrical interlayer conductivity (i.e. an electrical conductivity between a transparent electrode and a white layer) but also a blackness.

As the black inorganic fine particles, it is possible to use a heat-resistant black pigment together with or in place of the tricobalt tetraoxide ($Co_3O_4$). The kind of the heat-resistant black pigment is not particularly limited as long as such pigment has an excellent heat resistance. Generally, oxides and complex oxides of metals selected from the group consisting of chromium (Cr), cobalt (Co), nickel (Ni), iron (Fe), manganese (Mn) and ruthenium (Ru) can be the heat-resistant black pigment, and these oxides may be used alone, or two or more kinds of them may be used in combination.

The photosensitive resin is a resin having such a property of being insolubilized by crosslinking upon being irradiated with light. For instance, the photosensitive resin is a carboxyl group-containing photosensitive resin with an ethylenically unsaturated double bond therein. Specifically, the photosensitive resin may be, but is not limited to, the following resins:

- A carboxyl group-containing photosensitive resin obtained by adding an ethylenically unsaturated group, as a pendant, to a copolymer of an unsaturated carboxylic acid and a compound having an unsaturated double bond;
- A carboxyl group-containing photosensitive resin obtained by reacting a copolymer of a compound having an epoxy group and an unsaturated double bond and a compound having an unsaturated double bond with an unsaturated carboxylic acid to produce a secondary hydroxyl group, followed by reacting the secondary hydroxyl group with a polybasic anhydride;
- A carboxyl group-containing photosensitive resin obtained by reacting a compound having a hydroxyl group and an unsaturated double bond with a copolymer of an acid anhydride having an unsaturated double and a compound having an unsaturated double bond;
- A carboxyl group-containing photosensitive resin obtained by reacting an epoxy compound with an unsaturated monocarboxylic acid to produce a secondary hydroxyl group, followed by reacting the secondary hydroxyl group with a polybasic anhydride;
- A carboxyl group-containing photosensitive resin obtained by reacting a hydroxyl group-containing polymer with a polybasic anhydride to produce a carboxyl group-containing resin, followed by reacting the resulting carboxyl group-containing resin with a compound having an epoxy group and an unsaturated double bond.

The above photosensitive resins may be used alone, or used as a mixture.

Examples of resin that serves as an organic binder include, but are not limited to, polyvinyl alcohol, polyvinyl butyral, a methacrylic ester polymer, an acrylic ester polymer, an acrylic ester-methacrylic ester copolymer, an α-methyl styrene polymer, a butyl methacrylate resin and the like. These organic binders may be used alone or used as a mixture thereof.

The polymerization initiator is used for a polymerization of a monomer described hereinafter. Examples of the polymerization initiator include, but are not limited to, benzoins and benzoin alkyl ethers such as benzoin, benzoin methyl ether, benzoin ethyl ether and benzoin isopropyl ether; acetophenones such as acetophenone, 2,2-dimethoxy-2-phenylacetophenone and 1,1-dichloroacetophenone; aminoacetophenones such as 2-methyl-1-[4-(methylthio)phenyl]-2-morpholinopropan-1-one and 2-benzyl-2-dimethylamino-1-(4-morpholinophenyl)-butanone-1; anthraquinones such as 2-methylanthraquinone, 2-ethylanthraquinone, 2-t-butylanthraquinone and 1-chloroanthraquinone; thioxanthones such as 2,4-dimethylthioxanthone, 2,4-diethylthioxanthone, 2-chlorothioxanthone and 2,4-diisopropylthioxanthone; ketals such as acetophenone dimethyl ketal and benzyl dimethyl ketal; benzophenones such as benzophenone, or xanthones; phosphine oxides such as (2,6-dimethoxybenzoyl)-2,4,4-pentylphosphine oxide, bis(2,4,6-trimethylbenzoyl)-phenylphosphine oxide, 2,4,6-trimethylbenzoyldiphenylphosphine oxide and ethyl-2,4,6-trimethylbenzoyl phenylphosphinate; various peroxides; and the like.

Examples of the monomer include, but are not limited to, 2-hydroxyethyl acrylate, 2-hydroxypropyl acrylate, diethylene glycol diacrylate, triethylene glycol acrylate, polyethylene glycol diacrylate, polyurethane diacrylate, trimethylolpropane triacrylate, pentaerythritol triacrylate, pentaerythritol tetraacrylate, trimethylolpropane ethylene oxide-modified triacrylate, trimethylolpropanepropylene oxide-modified triacrylate, dipentaerythritol pentaacrylate, dipentaerythritol hexaacrylate, methacrylates that reacts with the above acrylates and the like. These monomers may be used alone to produce a monopolymer, or a copolymer of the above monomers may also be used.

Examples of the organic solvent include, but are not limited to, ketones such as methyl ethyl ketone and cyclohexanone; aromatic hydrocarbons such as toluene, xylene and tetramethylbenzene; glycol ethers such as cellosolve, methyl cellosolve, carbitol, methyl carbitol, butyl carbitol, propylene glycol monomethyl ether, dipropylene glycol monomethyl ether and triethylene glycol monoethyl ether; acetic esters such as ethyl acetate, butyl acetate, cellosolve acetate, butyl cellosolve acetate, carbitol acetate, butyl carbitol acetate and propylene glycol monomethyl ether acetate; alcohols such as ethanol, propanol, ethylene glycol, propylene glycol and terpineol; aliphatic hydrocarbons such as octane and decane; and petroleum-based solvents such as petroleum ether, petroleum naphtha and solvent naphtha. These organic solvents can be used alone, or two or more kinds of them can be used in combination.

In the electrode material paste, the content of each component is appropriately selected. For example, as for the white layer material paste, the content of the glass frits is preferably in the range of 0.5 to 200 parts by mass based on 100 parts by mass of the electrically-conductive fine particles; the content of the resin components of organic substance such as a photosensitive resin and an organic binder is preferably in the range of 10 to 80 parts by mass based on 100 parts by mass of the paste; the content of the polymerization initiator is preferably in the range of 1 to 30 parts by mass based on 100 parts by mass of the resin component; the content of the monomer is preferably in the range of 20 to 100 parts by mass based on 100 parts by mass of the resin component; and the content of the solvent is preferably in the range of 1 to 30 parts by mass based on 100 parts by mass of the paste. While on the other hand, as for the black layer material paste, the content of the glass frits is preferably in the range of 0.5 to 200 parts by mass based on 100 parts by mass of the black inorganic fine particles; the content of the resin components of organic substances such as a photosensitive resin and an organic binder is preferably in the range of 10 to 80 parts by mass based on 100 parts by mass of the paste; the content of the polymerization initiator is preferably in the range of 1 to 30 parts by mass based on 100 parts by mass of the resin component; the content of the monomer is preferably in the range of 20 to 100 parts by mass based on 100 parts by mass of the resin component; and the content of the solvent is preferably in the range of 1 to 40 parts by mass based on 100 parts by mass of the paste.

The electrode precursor film obtained by applying the "material pastes of the black layer and the white layer" containing the component described above, followed by a drying thereof is exposed by irradiating with light after disposing an exposure mask or the like. As a result, the unexposed area is formed on the portion on which the mask is disposed. After the exposure, the exposure mask is peeled and the electrode precursor film is developed with an aqueous alkali solution or the like to remove the unexposed area. After the development, parts of the white layer and black layer, the parts of which correspond to the portions covered with the mask, are removed to form an electrode pattern.

As for the exposure, it is possible to perform a contact exposure or a non-contact exposure by the use of an exposure mask (negative mask) having a predetermined electrode pattern. As an exposure light source, a halogen lamp, a high-pressure mercury lamp, a laser light, a metal halide lamp, a black lamp, an electrodeless lamp or the like may be used. The exposure amount is preferably in the range of about 50 $mJ/cm^2$ to about 1000 $mJ/cm^2$, and more preferably in the range of about 50 $mJ/cm^2$ to 500 $mJ/cm^2$. The development is preferably performed by a spraying method or a dipping method using an aqueous metal alkali solution such as an aqueous sodium carbonate, sodium hydroxide or calcium hydroxide solution.

After the development, the electrode precursor film is calcined, for example at a temperature ranging from about 400° C. to about 600° C., and preferably ranging from 500° C. to 600° C. Such calcining of the precursor film produces a bus electrode. During the calcining of the precursor film, the electrically-conductive particles contained in the electrode precursor film can be point-contacted with each other, and also the glass frits can be melted.

According to the present invention, as shown in FIG. 3(*c*), the surface of the resulting bus electrode (which has been obtained by calcining the precursor film) is subjected to a local heat treatment. This local heat treatment allows at least one of the electrically-conductive particles contained in the bus electrodes to allow. The bus electrodes after the local heat treatment includes a melted-solidified portion obtained by a melting and subsequent solidifying of the electrically-conductive particles, and thus has a decreased resistance value as a whole. For instance, as compared with the case of no "local heat treatment", the resistance value of the bus electrode decreases by about 5% to about 50%. Due to such decreased resistance of the bus electrode, a power consumption of the obtained PDP is also decreased. Particularly, the "melted-solidified portion derived from the electrically-conductive particles" can be formed in the surface of the white layer which contributes to discharge, and thus it becomes easy to discharge in the obtained PDP. This means that the PDP with a low power consumption is effectively realized according to the present invention.

It is preferred that the local heat treatment is a rapid thermal heat treatment (e.g. rapid thermal annealing). In other words, the surface of the bus electrode is heated preferably by subjecting the bus electrode to the rapid thermal heat treatment such as rapid thermal annealing (RTA). This means that a high thermal response, a rapid heat irradiation and a limited heat conduction (i.e. a local heating that does not allow the heat to transfer to a deeper region) are preferable as the local heat treatment. Specifically, it is preferable to use a heat source with a high thermal response and a capability to melt the electrically-conductive particles disposed in the vicinity of the surface of the bus electrode by rapid thermal irradiation and a limited heat conduction to prevent the heat effect from reaching a deeper region near the transparent electrode (12*a*, 13*a*) and substrate (10).

According to the present invention, it is preferable to use a heat source such as a plasma torch, a laser and a flash lamp. The plasma torch, laser or flash lamp advantageously facilitates a local heat treatment so that "melted-solidified portion derived from the electrically-conductive particles" is formed only in the vicinity of the surface of the bus electrode.

In a case of the plasma torch (60), a plasma torch annealing (PTA) process can be preferably carried out wherein only the limited shallow region of the bus electrode is subjected to the heat treatment. The PTA process is a process of forming a film by generating a plasma jet (high-temperature and high-speed jet) of a temperature higher than about 10000° C. with direct arc discharge between an anode and a cathode. As required, powder such as ceramics or cermet may be added into the plasma jet. With the PTA process, the heat (i.e. calorific value) applied to the electrically-conductive particles in the vicinity of the surface of the bus electrode can be controlled by adjusting the conditions such as the scan speed, gap between surface of the bus electrode and the heat source, number of scans and output power of the heat source. By controlling of the heat (i.e. calorific value) applied to the electrically-conductive particles, the thickness of the melted-solidified portion, and thus the resistance value of the entire bus electrode can be controlled.

In the case of local heat treatment using the laser, the surface of the bus electrode is irradiated by laser beam. The irradiation may be performed by means of excimer laser, YAG laser, $CO_2$ laser, ultraviolet ray, infrared ray, electron beam, X ray or energy beam caused by plasma. Just as an example, a laser beam with wavelength of preferably from 600 to 1200 nm and output power of preferably from 0.5 to 100 W may be used. In a heat treatment process by the use of the laser, the heat (i.e. calorific value) applied to the electrically-conductive particles in the vicinity of the surface of the bus electrode can be adjusted by controlling the output power of the laser or other operating conditions, and thereby the thickness of the melted-solidified portion, and thus the resistance value of the bus electrode can be suitably adjusted. Besides (a) controlling the output power of the laser, alternative controlling may be employed. For example, (b) controlling the scan speed of the laser, (c) controlling the beam width of the laser or (d) controlling the scan pitch of the laser may be carried out. While the above (a) to (d) may be carried out individually, they may also be carried out in various combinations.

In the case of heat treatment using the flash lamp, the heat of the local heat treatment can be applied only to the limited depth from the surface of the bus electrode by regulating the width of optical pulse and thus adjusting the heating period.

The thickness of the melted-solidified portion, namely, the thickness to be subjected to the local heat treatment is preferably adjusted to 70% or less of the thickness of the entire bus electrode (i.e. a limited part of the bus electrode, which corresponds to a limited thickness of 0.7 t or less from the surface of the bus electrodes, is preferably heated where "t" denotes the entire thickness of the bus electrodes), and more preferably adjusted to 60% or less of the thickness of the entire bus electrodes (i.e. a limited part of the bus electrode, which corresponds to a limited thickness of 0.6 t or less from the surface of the bus electrodes, is more preferably heated where "t" denotes the entire thickness of the bus electrodes).

By adjusting the upper limit of the "thickness of the melted-solidified portion" to preferably 70%, and more preferably 60% of the thickness of the entire bus electrodes, it is possible to suppress a substrate strain attributable to the application of the heat. While on the other hand, as for the lower limit of the "thickness of the melted-solidified portion", such lower limit is preferably 20% of the thickness of the entire bus electrodes (i.e. a limited part of the bus electrode, which corresponds to a limited thickness of 0.2 t or more from the surface of the bus electrodes, is preferably heated where "t" denotes the entire thickness of the bus electrodes), and more preferably 30% (i.e. a limited part of the bus electrode, which corresponds to a limited thickness of 0.3 t or more from the surface of the bus electrodes, is more preferably heated where "t" denotes the entire thickness of the bus electrodes). By adjusting to the lower limit of the "thickness of the melted-solidified portion" to preferably 20%, and more preferably 30% of the thickness of the entire bus electrodes, it is possible to suppress a variation of the resistance value of the bus electrodes even when there is a variation in the heat amount (e.g. calorific value) applied to the electrically-conductive particles in the surface layer of the bus electrode, or there is a variation in the shape of the display electrode during the mass production of the PDPs.

Figure 4:
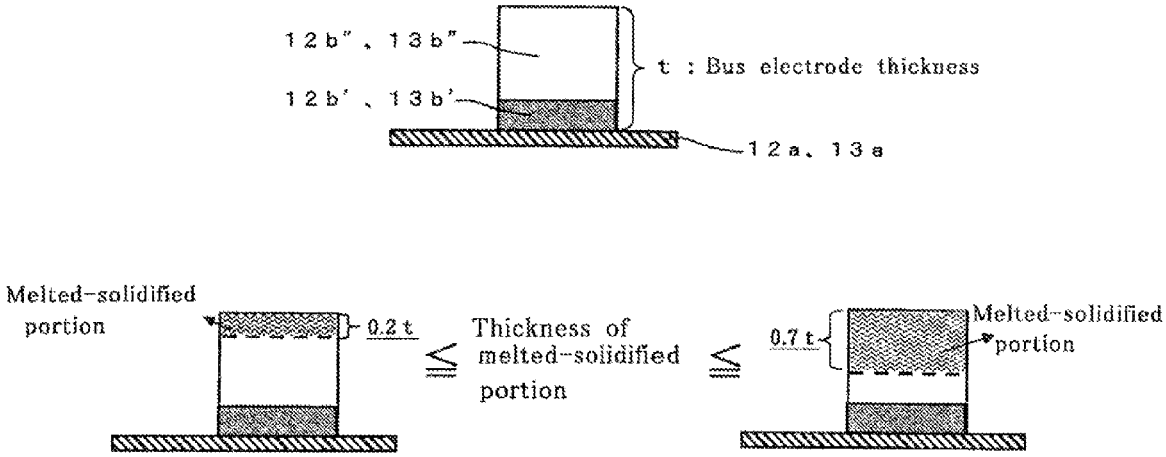
FIG. 4 is a schematic view for explaining a thickness of a melted-solidified portion.

Summarizing the above, the "melted-solidified portion formed from electrically-conductive particles" preferably has a thickness ranging of 0.2 t to 0.7 t from the surface of the bus electrodes, and more preferably a thickness ranging of 0.3 t to 0.6 t from the surface of the bus electrodes, assuming that the bus electrode has a thickness of "t" (see FIG. 4). Therefore, for instance, in a case where the thickness dimension of the bus electrode is about 10 μm on the whole, the "melted-solidified portion formed from electrically-conductive particles" preferably has a thickness dimension (or depth dimension) of 2 μm to 7 μm from the surface of the bus electrodes, and more preferably has a thickness dimension (or depth dimension) of 3 μm to 6 μm from the surface of the bus electrodes.

From the viewpoint of effectively eliminating and reducing "edge curl" in the bus electrodes, the edge curl portion and the vicinity thereof is preferably subjected to the local heat treatment. Namely, the surface of the bus electrodes is subjected to the local heat treatment so that the surface at the edge portion of the bus electrode is heated. While not intending to be bound by any specific theory, the electrode end is once melted by such local heat treatment, which contributes to an achievement of the elimination or reduction of the edge curl.

Subsequent to the formation of the bus electrode, a dielectric layer (15) is formed as shown in FIG. 3(*d*). The dielectric layer (15) can be formed by performance of a "method by melting a glass material" or a "sol-gel method" employed in a conventional production of the PDP front panel. For instance in the case of the "method by melting a glass material", a dielectric material paste obtained by mixing a glass powder containing $SiO_2$, $B_2O_3$, ZnO, $Bi_2O_3$ and the like, an organic solvent and a binder resin is applied by a screen printing method and then calcined to form the dielectric layer. The thickness of the dielectric layer (15) is preferably in the range of about 10 μm to about 30 μm. By adjusting the thickness of the dielectric layer to 10 μm or more, it is possible to suitably ensure a desired dielectric strength voltage and to suppress the electrode from being heated by the heat treatment, the heating of the electrode being attributable to a variation in the height of the edge curl portion of the electrode. While on the other hand, when the thickness of the dielectric layer is adjusted to 30 μm or less, it is possible to suitably decrease a dielectric constant of the dielectric layer and also to reduce a wattless power upon discharging. Examples of the organic solvent contained in a dielectric material paste include alcohols (for example, isopropyl alcohol) and ketones (for example, methyl isobutyl ketone). Examples of the binder resin contained in a dielectric material paste include a cellulose-based resin, an acrylic resin and the like.

The structure of the dielectric layer is not limited to a single-layered structure and may be a two-layered structure. Now, the formation of the "two-layered structure dielectric layer composed of a first dielectric layer (lower layer) and a second dielectric layer (upper layer)" will be described by way of the "method by melting a glass material".

A first dielectric material of the first dielectric layer contains, for example, 15% by weight to 40% by weight of bismuth oxide ($Bi_2O_3$) and 0.5% by weight to 15% by weight of calcium oxide (CaO), and may additionally contain 0.1% by weight to 7% by weight of at least one kind of oxide selected from molybdenum oxide ($MoO_3$), tungsten oxide ($WO_3$), cerium oxide ($CeO_2$) and manganese oxide ($MnO_2$). Furthermore, the first dielectric material may contain 0.5% by weight to 12% by weight of at least one kind of oxide selected from strontium oxide (SrO) and barium oxide (BaO).

Such a first dielectric material may also contain 0% by weight to 10% by weight of at least one kind of substance selected from the group consisting of copper oxide (CuO), chromium oxide ($Cr_2O_3$), cobalt oxide ($Co_2O_3$), vanadium oxide ($V_2O_7$) and antimony oxide ($Sb_2O_3$) in place of molybdenum oxide ($MoO_3$), tungsten oxide ($WO_3$), cerium oxide ($CeO_2$) and manganese oxide ($MnO_2$). Furthermore, the first dielectric material may have a composition free from a lead component.

The compositions of the first dielectric material may be those other than the composition described above. For instance, the first dielectric material may consist of components (components free from lead) of 0% by weight to 40% by weight of zinc oxide (ZnO), 0% by weight to 35% by weight of boron oxide ($B_2O_3$), 0% by weight to 15% by weight of silicon oxide ($SiO_2$), 0% by weight to 10% by weight of aluminum oxide ($Al_2O_3$) and the like.

The first dielectric material described above is ground by a wet jet mill or a ball mill so that an average particle diameter thereof becomes 0.5 μm to 2.5 μm, and thereby a powder material is provided. Next, 55% by weight to 70% by weight of this powder material and 30% by weight to 45% by weight of a binder component are kneaded by a three roll to obtain a first dielectric material paste that is suitable for a die coating or a printing. The binder component may be terpineol or butyl carbitol acetate that contains 1% by weight to 20% by weight of an ethyl cellulose or an acryl resin. Also, a printability of the first dielectric material paste may be improved by optionally adding dioctyl phthalate, dibutyl phthalate, triphenyl phosphate and tributyl phosphate as plasticizers, and also adding glycerol monooleate, sorbitan sesquioleate, HOMOGENOL (trade name of Kao Corporation) and/or a phosphoric ester of an alkylallyl group as dispersing agents to the material paste.

The obtained first dielectric material paste is applied onto a substrate, followed by a heat treatment thereof. Specifically, the first dielectric material paste is printed on the front substrate so as to cover a display electrode by a performance of a die coating method or a screen printing method. Thereafter, the printed paste is dried and then calcined to form a first dielectric layer therefrom.

The formation of the second dielectric layer will be described below. A second dielectric material of the second dielectric layer contains, for example, 15% by weight to 40% by weight of bismuth oxide ($Bi_2O_3$) and 6.0% by weight to 28% by weight of barium oxide (BaO), and may additionally contain 0.1% by weight to 7% by weight of at least one kind of oxide selected from the group consisting of molybdenum oxide ($MoO_3$), tungsten oxide ($WO_3$), cerium oxide ($CeO_2$) and manganese oxide ($MnO_2$). Furthermore, the second dielectric material may contain 0.1% by weight to 7% by weight of at least one kind of oxide selected from calcium oxide (CaO) and strontium oxide (SrO).

The compositions of the second dielectric material may be those other than the composition described above. For instance, the second dielectric material may consist of components (components free from lead) of 0% by weight to 40% by weight of zinc oxide (ZnO), 0% by weight to 35% by weight of boron oxide ($B_2O_3$), 0% by weight to 15% by weight of silicon oxide ($SiO_2$), 0% by weight to 10% by weight of aluminum oxide ($Al_2O_3$) and the like.

The second dielectric material described above is ground by a wet jet mill or a ball mill so that an average particle diameter thereof becomes 0.5 μm to 2.5 μm, and thereby a powder material is provided. Next, 55% by weight to 70% by weight of this powder material and 30% by weight to 45% by weight of a binder component are kneaded by a three roll to obtain a second dielectric material paste that is suitable for a die coating or a printing. The binder component may be an ethyl cellulose or a butyl carbitol acetate. Also, a printability of the second dielectric material paste may be improved by optionally adding dioctyl phthalate, dibutyl phthalate, triphenyl phosphate and tributyl phosphate as plasticizers, and also adding glycerol monooleate, sorbitan sesquioleate, HOMOGENOL (trade name of Kao Corporation) and/or a phosphoric ester of an alkylallyl group as dispersing agents to the material paste.

The obtained second dielectric material paste is applied onto the first dielectric layer, followed by a heat treatment thereof. Specifically, the second dielectric material paste is printed on the first dielectric layer by a performance of a die coating method or a screen printing method. Thereafter, the printed paste is dried and then calcined to form a second dielectric layer therefrom.

As the film thickness of the entire dielectric layer becomes smaller, the effect of improving a PDP brightness and reducing a discharge voltage becomes remarkable. Therefore, the film thickness of the entire dielectric layer is preferably set as small as possible with a proviso that the dielectric strength voltage is not reduced. Making much account of these matters and the viewpoint of visible light transmittance, it is preferred that the film thickness of the entire dielectric layer is 41 μm or less wherein the film thickness of the first dielectric layer is in the range of 5 μm to 15 μm and the film thickness of the second dielectric layer is in the range of 20 μm to 36 μm.

By the way, when the content of bismuth oxide ($Bi_2O_3$) is decreased, there is a disadvantage in that a softening point is raised. However, the rise of the softening point can be suppressed by inclusion of additives such as alkali metal. Also, a reduction action of the alkali metal in the dielectric layer may cause a yellowing phenomenon due to a silver component of the bus electrodes. However, when the bus electrode contains metal oxides serving as additives, the effect of suppressing the yellowing phenomenon is provided due to an oxidizability of these metal oxides.

Next, the sol-gel method as the method for forming the dielectric layer will be described in detail below. Upon performing the sol-gel method, first, a pasty material containing a glass component, an organic solvent and the like is prepared (hereinafter, the prepared dielectric material is also referred to as "dielectric material paste").

The glass component is preferably a pasty or sol-like fluid material obtained from an organic solvent and a precursor material upon carrying out the sol-gel process. More preferably, the glass component comprises polysiloxane with a siloxane backbone (—Si—O—) and an alkyl group. The siloxane backbone may be a linear, cyclic or three-dimensional network siloxane backbone. The alkyl group preferably has about 1 to 6 carbon atoms. Examples of the alkyl group include a methyl group, an ethyl group, a propyl group, a butyl group, a pentyl group and an hexyl group. The siloxane backbone may contain one or more kinds of these alkyl groups. Instead of the alkyl group, a functional group similar to the alkyl group such as an alkylene group (e.g. methylene group, ethylene group, propylene group or butylene group) may also be contained in the glass component.

For instance, the glass component can be prepared by mixing a precursor material such as silicon alkoxide with an organic solvent and adding water and/or a catalyst thereto. More specifically, the glass component can be prepared by mixing a silicon alkoxide (particularly preferably a silicon alkoxide with an alkyl group) with an organic solvent and equally adding a small amount of water and a catalyst under a normal or elevated temperature while stirring them to proceed a hydrolysis or condensation polymerization thereof.

The above precursor material of the glass component is not particularly limited. Such precursor material may be a completely inorganic precursor material with no alkyl group, such as methyl silicate and ethyl silicate. More preferably, a precursor material of the glass component may be methyltrimethoxysilane, methyltriethoxysilane, methyltriisopropoxysilane, ethyltrimethoxysilane, ethyltriethoxysilane, ethyltriisopropoxysilane, octyltrimethoxysilane, octyltriethoxysilane, vinyltrimethoxysilane, vinyltriethoxysilane, phenyltrimethoxysilane, phenyltriethoxysilane, trimethoxysilane, triethoxysilane, triisopropoxysilane, fluorotrimethoxysilane, fluorotriethoxysilane, dimethyldimethoxysilane, dimethyldiethoxysilane, diethyldimethoxysilane, diethyldiethoxysilane, dimethoxysilane, diethoxysilane, difluorodimethoxysilane, difluorodiethoxysilane, trifluoromethyltrimethoxysilane, trifluoromethyltriethoxysilane, or the other alkoxide-based organic silicon compound ($Si(OR)_4$) having an alkyl group or a functional group similar to the alkyl group, such as tetratertiary butoxysilane ($t\text{-}Si(OC_4H_9)_4$), tetrasecondary butoxysilane $sec\text{-}Si(OC_4H_9)_4$ or tetratertiary amyloxysilane $Si[OC(CH_3)_2C_2H_5]_4$. These precursor materials can be used alone, but it is possible to suitably combine the above precursor materials with each other.

There is no particular limitation on the organic solvent. Examples of the organic solvent of the dielectric material include, but are not limited to, alcohols such as methanol, ethanol, 1-propanol, 2-propanol, hexanol and cyclohexanol; glycols such as ethylene glycol and propylene glycol; ketones such as methyl ethyl ketone, diethyl ketone and methyl isobutyl ketone; terpenes such as α-terpineol, β-terpineol and γ-terpineol; ethylene glycol monoalkyl ethers; ethylene glycol dialkyl ethers; diethylene glycol monoalkyl ethers; diethylene glycol dialkyl ethers; ethylene glycol monoalkyl ether acetates; ethylene glycol dialkyl ether acetates; diethylene glycol monoalkyl ether acetates; diethylene glycol dialkyl ether acetates; propyleneglycol monoalkyl ethers; propylene glycol dialkyl ethers; propylene glycol monoalkyl ether acetates; propylene glycol dialkyl ether acetates; and monoalkyl cellosolves. These organic solvents can be used alone, but it is possible to suitably combine the above organic solvents with each other.

The dielectric material paste contains silica particles (i.e. solid glass component) for the purpose of effectively preventing cracking of the dielectric layer. Mean particle size of the silica particles is preferably in the range of from 50 to 200 nm. The particle sizes of 50 nm or larger makes it possible to more effectively prevent cracking from occurring. The reason for this is that it can mitigate the stress of the dielectric layer since there is provided an increased gap between the silica grains in the dielectric layer, and also it can decrease specific surface area of the particles allowing uniform and sufficient amount of polysiloxane to cover the particles on the surface thereof. While on the other hand, the particle sizes of 200 nm or smaller makes it possible to increase permeability to visible light with wavelength of 400 to 800 nm, which lead to an achievement of a desired optical characteristic. The silica particles may not necessarily be of a single size, and thus may have two or more sizes. When the silica particles have two or more particle sizes, a packing density of the silica particles can be increased in the dielectric layer, and thus an occurrence of the cracking can be more effectively prevented. The phrase "particle size" as used herein substantially means the maximum dimension selected among dimensions of the particle in various directions. The phrase "mean particle size" substantially means a particle size calculated as a number average by measuring each size of 10 particles for example, based on an electron micrograph of the particles.

Any suitable silica particles such as crystalline silica particles and amorphous silica particles may be used. The silica particles may be used as a dry powder. Alternatively, the silica particles may also be used when dispersed in water or organic solvent to form a sol state thereof. There is no limit to the surface condition and the porosity of the silica particles. Thus, the silica particles that are commercially available may be used. The silica particles may be added either before or after preparing a sol-like dielectric material.

The amount of silica particles to be contained in the dielectric material is preferably determined in accordance to the ratio to the amount of siloxane backbone that remains in the dielectric layer. For instance, the amount of silica particles to be contained in the dielectric material may be roughly in the range of 10 to 99% by weight, and preferably roughly in the range of 50 to 90% by weight with respect to the total weight of the dielectric layer to be finally formed.

The dielectric material paste may optionally comprise a binder resin in order to improve the property of the dielectric material paste to make it easier to apply. Examples of the binder resin include polyethylene glycol, polyvinyl alcohol, polyvinyl butyral, methacrylate ester polymer, acrylate ester polymer, acrylate ester-methacrylate ester copolymer, α-methylstyrene polymer, butyl methacrylate resin and cellulose-based resin. These binder resins can be used alone, but it is possible to suitably combine the above binder resins with each other. While the dielectric material paste undergoes weight loss due to an evaporation of the organic solvent at a high temperature (e.g. temperature of about 200° C. to about 400° C.), the rate of decreasing weight of the paste as a whole can be suppressed, and thus a stress attributable thereto can be suppressed by using the binder resin. In addition, the binder resin can serve to assist a bonding between the silica particles at higher temperatures. The dielectric material consisting of the above components is preferably used in the form of a paste. It is thus preferred that the viscosity of the dielectric material is in the range of from 1 mPa·s to about 50 Pa·s at the room temperature (i.e. 25° C.) and a shear rate of 1000 [1/s]. When the viscosity of the dielectric material is within the above range, the undesirable spreading of the dielectric material can be effectively prevented upon an application thereof.

The contents of the components contained in the dielectric material are not particularly limited as long as they are usual contents used to obtain a typical dielectric layer of a PDP (more specifically, as long as they are usual contents used to form a dielectric layer by a sol-gel process). Just as an example, however, the concentration of solid components in the dielectric material is preferably in the range of 5% to 60% by weight, and more preferably in the range of 15% to 35% by weight in light of the effects of the present invention. The concentration of solid components used herein means the weight proportion of the glass component with respect to the total weight of the dielectric material, or the weight proportion of the glass component and the binder resin with respect to the total weight of the dielectric material. Larger thickness of the dielectric layer requires a larger thickness thereof in wet state. In this regard, the concentration of solid components of less than 5% by weight requires it to use a larger quantity of the paste, thus resulting in a higher materials cost. The concentration of solid components of more than 60% by weight, on the other hand, is not desirable because it brings the glass components (for example, grains of polyalkylsiloxane oligomer) too close so that the aggregation thereof tends to occur.

It is preferred that a slit coater process is employed to apply the dielectric material. The slit coater process is a process of applying a paste material to a desired surface by discharging a paste material under pressure from a wide nozzle. The dielectric material can also be applied by a dispensing process. In the dispensing process, a dielectric material paste is charged into a cylindrical vessel equipped with a small-diameter nozzle, and then the dielectric material paste is discharged therefrom by applying an air pressure to an aperture portion opposed to the nozzle. Alternatively, a spraying process, a printing process and a photolithography process may also be employed.

After the dielectric material that has been applied, the organic solvent contained therein is diminished by allowing it to evaporate. As a result, a dielectric precursor layer is formed. In other words, the dielectric precursor layer is formed by diminishing the amount of the organic solvent from the applied dielectric material layer. To diminish the organic solvent, the organic solvent must be evaporated from the applied dielectric material. For this purpose, the applied dielectric material may be either dried or placed under a reduced pressure or under a vacuum atmosphere. In a case where a drying process is employed for gasifying the organic solvent, it is preferable to place the applied dielectric material at a drying temperature of about 50 to 200° C. under an atmospheric pressure for 0.1 to 2 hours. When the reduced pressure or vacuum atmosphere is employed, the organic solvent is gasified by keeping the pressure below the saturated vapor pressure of the organic solvent under the atmosphere of the reduced pressure or vacuum. For instance, it is preferable to place the applied dielectric material under a reduced pressure or vacuum atmosphere of 7 to 0.1 Pa. As required, "reduced pressure or vacuum atmosphere" and "heat treatment" may be combined.

Subsequently, the dielectric precursor layer is subjected to a heat treatment to form a dielectric layer therefrom. In this heat treatment, a condensation polymerization reaction proceeds in the dielectric precursor layer as the dielectric precursor layer is heated. Such condensation polymerization reaction eventually produces the dielectric layer. In a case where the dielectric precursor layer contains the binder resin, the binder resin is burned so that it is removed from the dielectric precursor layer. The heating temperature of the dielectric precursor layer is determined by the calorific value required for the condensation polymerization reaction and other factors such as the boiling point and content of the organic solvent that may still remain in the precursor layer. The heating temperature of the dielectric precursor layer is typically in the range of about 450° C. to about 550° C. Similarly, the period of time during of which the dielectric precursor layer is subjected to the heat treatment is also determined by comprehensively considering the calorific value required for the condensation polymerization reaction and other factors such as the boiling point and content of the organic solvent that may still remain in the precursor layer. Such heating time of the dielectric precursor layer, which depends on the kind of the dielectric material, is typically in the range of about 0.5 hour to about 2 hour. As a heat treatment means, a heating chamber (e.g. calcining furnace) may be used, for example.

On the surface of the dielectric layer to be formed, a level difference (i.e. "surface unevenness" or "step") of the electrode caused by the edge curl of the bus electrodes is 5 μm or less, and preferably 0 μm in principle so as to suppress the occurrence of the cracking. For this purpose, a "method in which the level difference of the material paste after applying is suppressed by increasing the viscosity and a high solid concentration of the dielectric material paste", a "method in which a movement of solid parts in a material paste, attributable to a convection during drying, is suppressed by increasing a boiling point of a solvent in the material paste and also decreasing an evaporation rate of the solvent due to optimization of process conditions in the drying and calcining steps" or the like is effective. However, as for the present invention, the edge curl can be eliminated and reduced by the "local heat treatment" described above, thus making it possible to suppress the occurrence of cracking without depending on the above method.

Subsequent to the formation of the dielectric layer (15), a protective layer (16) is formed as shown in FIG. 3(*e*). For instance, the protective layer is formed on the dielectric layer by performance of a sputter method (sputtering method) or a vacuum deposition method. Preferably, the protective layer made of magnesium oxide (MgO) is formed. The component of the protective layer is not limited to magnesium oxide and may be, for instance, at least one kind of component selected from the group consisting of calcium oxide, strontium oxide and barium oxide (as a matter of course, the protective layer may also be made of both such component and magnesium oxide). Such components have a smaller work function than that of magnesium oxide and can contribute to a decrease in an operating voltage or a drive voltage. The thickness of the protective layer is preferably in the range of about 5 μm to about 30 μm, and more preferably in the range of about 10 μm to about 20 μm. As the vacuum deposition method, CVD or PVD may be used in which case an electron beam vacuum deposition method or the like may be used for example. The method is not limited to the sputter method or the vacuum deposition method, and other suitable methods may be used as long as a desired protective layer can be formed.

The present invention has been hereinabove described with reference to the preferred embodiments by way of example. It will be understood by those skilled in the art that the present invention is not limited to such embodiments and can be modified in various ways. For example, the following embodiments (A) and (B) are possible:

(A) Embodiment in which Softening Point Temperature of Glass Material of Black Layer is 400 to 550° C.

In a case of the bus electrodes having the two-layered structure of the black layer and the white layer, it is preferred in the present invention that a softening point temperature of the glass material of the black layer is in the range of 400° C. to 550° C. The black layer contains a black pigment for the purpose of improving contrast at the time of image display of the PDP, and this black pigment ensures a contrast on the glass substrate side by a sedimentation thereof on the glass substrate side upon the calcining of the electrode. When the softening point temperature of the glass material of the black layer is lowered, the viscosity of the glass at the time of calcining can decreases and thus the black pigment is likely to settle out. Therefore, when the softening point temperature of the glass material of the black layer is low, it is possible to decrease the "L* value established on 1976 by Commission Internationale de l'Eclairage (CIE) so as to express a color by mathematization (L*a*b* color coordinate system)", thus making it possible to improve contrast at the time of image display. For this purpose, the softening point temperature of the glass material of the black layer is preferably lowered to 550° C. or lower in the present invention. While on the other hand, in order to maintain the electrode shape even in the subsequent production process, such softening point temperature is preferably set to 400° C. or higher.

(B) Embodiment in which Bus Electrode Glass Material Containing an Additive Therein is Used With respect to an action of metal oxide to be added in the bus electrode material paste, the metal oxide can accelerate a combustion of the organic binder in the paste. Namely, the effect as the oxide is provided by the metal oxide. In this regard, bismuth oxide ($Bi_2O_3$) in the paste acts as an oxidizing agent, the degree of an oxidation action is low. Therefore, at least one oxide of the substance selected from the group of molybdenum (Mo), ruthenium (Ru), cerium (Ce), tin (Sn), copper (Cu), manganese (Mn), antimony (Sb) and iron (Fe) may be mixed as the additive in the bus electrode material paste. Whereby, the combustion of the organic binder in the calcining step of the bus electrode is accelerated, and thereby making it possible to effectively suppress the generation of bubbles and thus prevent the bubbles from entering the dielectric layer. Herein, when these additives are directly mixed in the paste material, the additives are scattered in the paste or the electrode layer since the amount of the additives is too small with respect to the entire paste. As a result, the portion where the effect of combusting the organic binder by the additives is exerted and the portion where the effect is not exerted are distributed, and thereby making it impossible to sufficiently suppress the generation of bubbles. Therefore, a glass material containing these additives preliminarily mixed therein may be used as the glass material of the paste. These additives are uniformly dispersed in the electrode after the applying of the paste and subsequently melting thereof, thus making it possible to uniformly exert the effect of suppressing the generation of bubbles over the entire electrode. Namely, at least one oxide of the substance selected from the group of molybdenum (Mo), ruthenium (Ru), cerium (Ce), tin (Sn), copper (Cu), manganese (Mn), antimony (Sb) and iron (Fe) can effectively exert a catalytic effect of accelerating combustion of the organic component in the bus electrodes in the calcining step, thus making it possible to suppress an inclusion of bubbles in the dielectric layer in the subsequent step of forming the dielectric layer. This means that it is possible to effectively improve the production yield of the PDP by reducing failures attributable to the bubbles, such as discharge failure. A specific method of preparing the "glass material containing additives preliminarily mixed therein" is exemplified as follows. First, the step of mixing material powders is performed. Specifically, a first material powder containing 15% by weight to 40% by weight of bismuth oxide ($Bi_2O_3$), 3% by weight to 20% by weight of silicon oxide ($SiO_2$) and 10% by weight to 45% by weight of boron oxide ($B_2O_3$) as a main material powder is mixed with a second material powder containing at least one oxide of the substance selected from the group of molybdenum (Mo), ruthenium (Ru), cerium (Ce), tin (Sn), copper (Cu), manganese (Mn), antimony (Sb) and iron (Fe). It is preferred in the step of mixing material powders that 0.1% by weight to 5% by weight of the second material powder is weighed, followed by mixing and dispersing. Subsequently, the melt vitrification step of proving a molten glass is performed by melting the mixed material powders at a temperature of about 1000° C. to 1600° C. The resulting molten glass is solidified by cooling it, and thereby a glass material is obtained. This glass material is ground by a wet jet mill or a ball mill so that the resulting particles thereof have the average particle diameter of 0.5 μm to 2.5 μm. In this way, a desired "glass powder material containing additives preliminarily mixed therein" is finally obtained.

[Plasma Display Panel of the Present Invention]

The plasma display panel of the present invention will now be described. Such plasma display panel is obtained by performance of the production method described above. The plasma display panel of the present invention comprises:

a front panel wherein an electrode, a dielectric layer and a protective layer are formed on a substrate of the front panel; and a rear panel wherein an electrode, a dielectric layer and a barrier rib and a phosphor layer are formed on a substrate of the rear panel;

the front panel and the rear panel being oppositely disposed to each other;

wherein the electrode of the front panel is composed of a transparent electrode and a bus electrode; and the bus electrode at least comprises a melted-solidified portion obtained by a melting and subsequent solidifying of electrically-conductive particles.

The bus electrode of the plasma display panel according to the present invention has been obtained by subjecting the surface thereof to the local heat treatment. Therefore, the bus electrode includes the "melted-solidified portion obtained by melting and subsequently solidifying electrically-conductive particles". Preferably, the melted-solidified portion is provided in the vicinity of the surface of the bus electrode. Specifically, the melted-solidified portion extends to a limited depth of the bus electrode from the surface of the bus electrode. This means that, in a case of the bus electrode composed of the two-layered structure of the black layer and the white layer, the melted-solidified portion is mainly provided in the white layer, not in the black layer.

In such a melted-solidified portion, there is much contact between the electrically-conductive particles since the melting of the electrically-conductive particles has occurred. Therefore, in the plasma display panel of the present invention, the ratio of contact between the electrically-conductive particles on the surface side of the bus electrode becomes higher than that on the lower side of the bus electrode (to put it another way, in the melted-solidified portion, the electrically-conductive particles are not in a "point-contact" with each other, but in a "surface-contact" with each other).

In the plasma display panel of the present invention, as shown in FIG. 4, the "melted-solidified portion derived from the electrically-conductive particles" preferably has a thickness of 0.2 t to 0.7 t from the surface of the bus electrode, assuming that the bus electrode has a thickness of "t" on the whole. As a result, the PDP with a low power consumption is realized. Namely, the plasma display panel of the present invention exhibits a low resistance of the bus electrode surface, which can facilitate a discharge due to much current flow, and thereby the PDP with a low power consumption is realized. Compared with the case where no "local heat treatment" is performed (i.e. a bus electrode with the same thickness condition in the prior art that has been not subjected to the local heat treatment), the bus electrode according to the present invention has the decreased resistance value by about 5% to about 50%, preferably about 10% to about 40%, and more preferably about 15% to about 30%.

By the way, in a case where the production method of the present invention includes the above embodiment (A), the black layer of the bus electrode includes a glass material with its softening temperature of 400° C. to 550° C. In this case, the plasma display panel of the present invention has an improved contrast in terms of the image display of the PDP.

The plasma display panel of the present invention has various features in addition to the above. Such features, however, have been hereinabove described in [Production Method of the Present Invention], and so repetitive descriptions are omitted.

EXAMPLES

Examples associated with the present invention will be described below. In the present Example, description is made by referring to "white layer" as "metal electrode layer" for the sake of convenience. It should be noted that the scope of the present invention is not limited by the Examples.

(Paste Material for Formation of Black Layer of Bus Electrode)

- Black inorganic fine particles (32.6 parts by mass based on the entire paste material): Tricobalt tetraoxide ($Co_3O_4$) having a particle diameter ranging from 200 nm to 300 nm and a specific surface area ranging from 4 to 16 $m^2/g$
- Glass frit (16.3 parts by mass based on the entire paste material): Glass frit with the composition containing bismuth oxide ($Bi_2O_3$), boron oxide ($B_2O_3$) and silicon oxide ($SiO_2$) as main components
- Resin component containing photosensitive resin and organic binder (30 parts by mass based on the entire paste material): Carboxyl group-containing photosensitive resin having an ethylenically unsaturated double bond (carboxyl group-containing photosensitive resin obtained by adding an ethylenically unsaturated group as a pendant to a copolymer of an unsaturated carboxylic acid and a compound having an unsaturated double bond)
- Polymerization initiator (0.6 part by mass based on the entire paste material): 2-benzyl-2-dimethylamino-1-(4-monopholinophenyl)-butane
- Monomer (10.5 parts by mass based on the entire paste material): Pentaerythritol acrylate
- Solvent (10.0 parts by mass based on the entire paste material): Dipropylene glycol monomethyl ether (Paste Material for Formation of Metal Electrode Layer of Bus Electrode)

- Electrically-conductive particles (49.8 parts by mass based on the entire paste material): Silver particles having a particle diameter of 200 nm to 1 μm
- Glass frit (24.9 parts by mass based on the entire paste material): Glass frit with the composition containing bismuth oxide ($Bi_2O_3$), boron oxide ($B_2O_3$) and silicon oxide ($SiO_2$) as main components
- Resin component containing photosensitive resin and organic binder (15.0 parts by mass based on the entire paste material): Carboxyl group-containing photosensitive resin having an ethylenically unsaturated double bond (carboxyl group-containing photosensitive resin obtained by adding an ethylenically unsaturated group as a pendant to a copolymer of an unsaturated carboxylic acid and a compound having an unsaturated double bond)

Polymerization initiator (0.3 part by mass based on the entire paste material): 2-benzyl-2-dimethylamino-1-(4-monopholinophenyl)-butane Monomer (0.01 part by mass based on the entire paste material): Pentaerythritol acrylate Solvent (10.0 parts by mass based on the entire paste material): Dipropylene glycol monomethyl ether (Production of Front Panel)

Figure 5A:
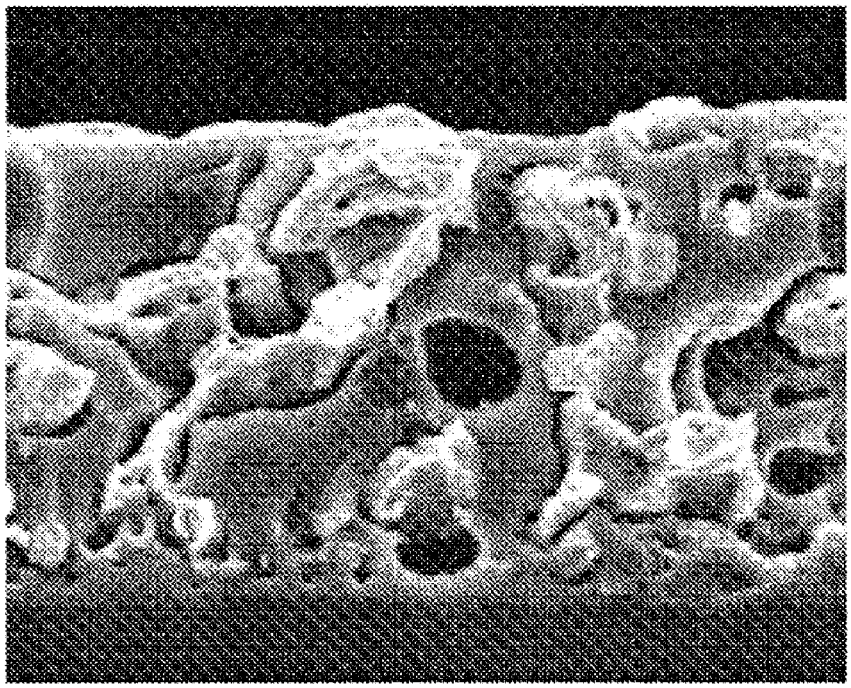
FIGS. 5(*a*) and 5(*b*) are micrographs of a section of a bus electrode taken in an Example.
Figure 5B:
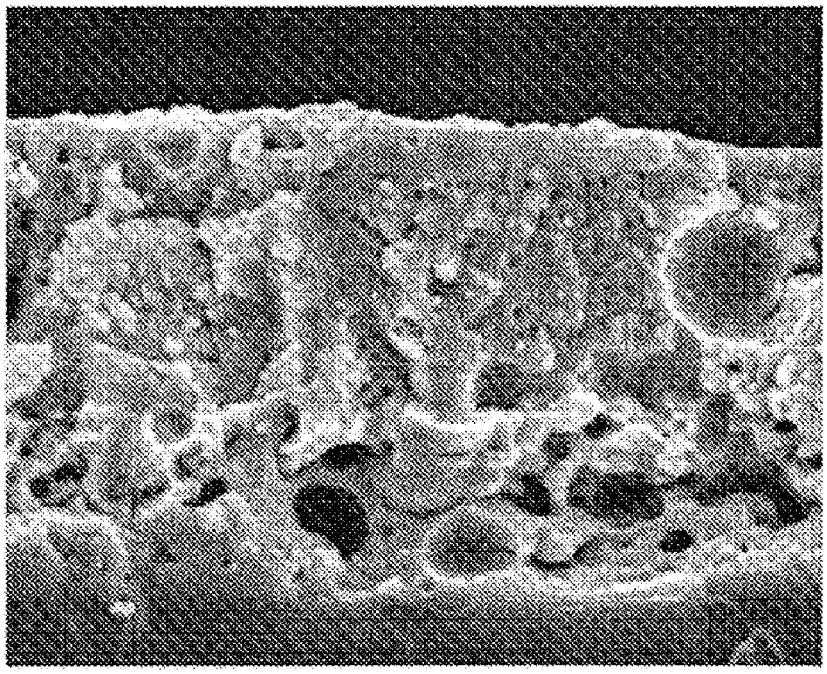

First, a transparent electrode made of ITO (about 120 μm in width and about 100 nm in thickness of the transparent electrode) was formed on a surface of a 1.8 mm thick glass substrate (i.e. soda-lime glass, manufactured by Nippon Electric Glass Co., Ltd.). On such transparent electrode, a black layer paste material of the bus electrode was applied by a slit coating method and then dried at about 80° C. Subsequently, a metal electrode layer paste material was applied by a slit coating method and then dried at about 80° C. to form a precursor film of the bus electrode. Thereafter, the electrode precursor film was subjected to exposure and development process, followed by being calcined in the sequence of raising the temperature at a rate of about 30° C./minute for about 30 minute, keeping the temperature at 500° C. for about 20 minutes and then lowering the temperature at a rate of about 2° C./minute for about 5 hours, in the atmosphere. This process resulted in the bus electrode with an electrode width of about 80 to 100 μm, a distance between electrodes of about 80 to 100 μm and an electrode thickness of 10 to 12 μm (see FIG. 5(*a*)). FIG. 5(*a*) is a micrograph wherein a glass substrate was cut perpendicularly to a longitudinal direction of its bus electrode and the cross section thereof was observed by a scanning electron microscope. The upper portion of the micrograph of FIG. 5(*a*) corresponds to the surface of the bus electrode. It is apparent from FIG. 5(*a*) that a contact between the particles of silver has locally occurred over the entire region of the cross section of the bus electrode. It should be noted that the black portion observed in the micrograph corresponds to a melted-coagulated portion of the glass frit.

Thereafter, as a local heat treatment, the electrically-conductive particles distributed in the vicinity of the surface of the bus electrode were melted by means of a PTA device manufactured by Aeroplasma Co., Ltd. under conditions of gap of 20 mm between nozzle and the bus electrode, no trimming, no $N_2$ cooling, output power of 43 kW regarding anode torch and scanning speed of 500 nm/s. As a result, a melted-solidified portion with a thickness of about 6.7 μm was formed (see FIG. 5(*b*)). FIG. 5(*b*) is a micrograph wherein a glass substrate was cut perpendicularly to a longitudinal direction of its bus electrode and the cross section thereof was observed by a scanning electron microscope, similar to FIG. 5(*a*). The upper portion of the micrograph of FIG. 5(*b*) corresponds to the surface of the bus electrode. It is apparent from FIG. 5(*b*) that the silver particles in the vicinity of the surface of the bus electrode have been melted and subsequently solidified. This means that the melted-solidified particles of the silver are in a surface-contact between each other, not in a point-contact with each other.

Next, by means of Digital Multimeter (manufactured by SANWA Co., Model EM-3000), the resistance values per 1 cm in length of the bus electrode before and after the PTA treatment were respectively measured. As a result, it was confirmed from Table 1 that the resistance value of the bus electrode after the PTA treatment had decreased by about 20% as compared with that of the bus electrode before the PTA treatment. The main reason for this was that the melting and subsequent solidifying of the silver particles in the surface of the bus electrode brought about a surface contact between the silver particles, leading to an improvement in an electrical conductivity.

TABLE 1

Evaluation results of resistance value of bus electrode before and after PTA treatment

| | | Case 1 (PTA treatment) | Case 2 (no PTA treatment) |
|---|---|---|---|
| Resistance value | Bus electrode 1 | 1.2 Ω | 1.5 Ω |
| | Bus electrode 2 | 1.3 Ω | 1.6 Ω |
| | Bus electrode 3 | 1.2 Ω | 1.5 Ω |
| | Bus electrode 4 | 1.2 Ω | 1.5 Ω |
| | Bus electrode 5 | 1.2 Ω | 1.6 Ω |
| | Average | 1.2 Ω | 1.5 Ω |

Figure 6:
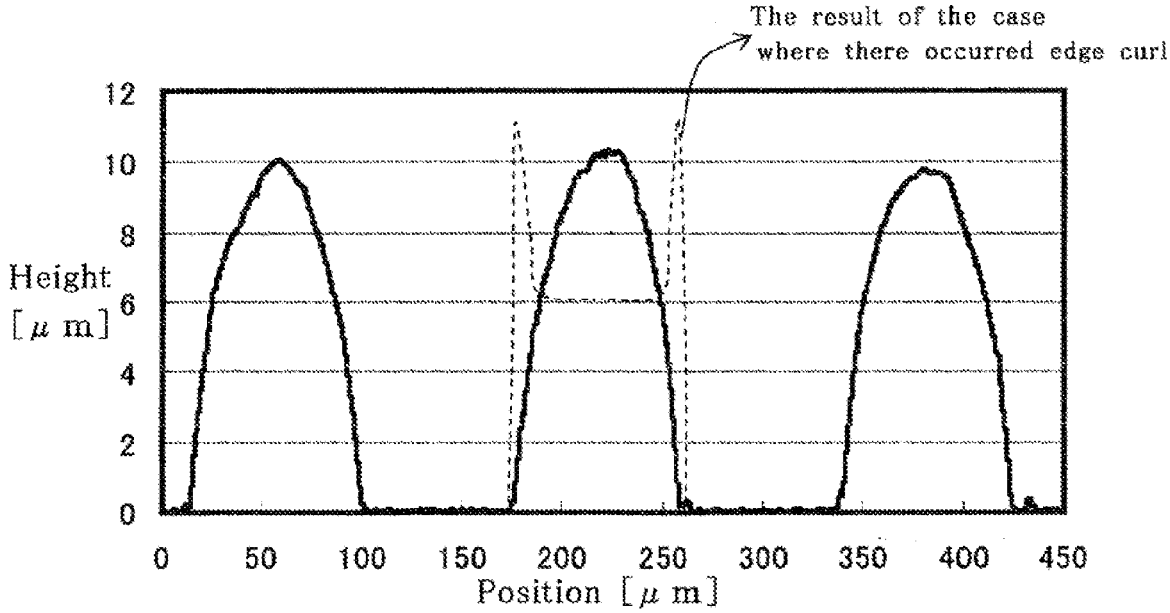
FIG. 6 is a graph showing the evaluation results of a shape of the bus electrode film after a PTA treatment (Example).
Figure 7:
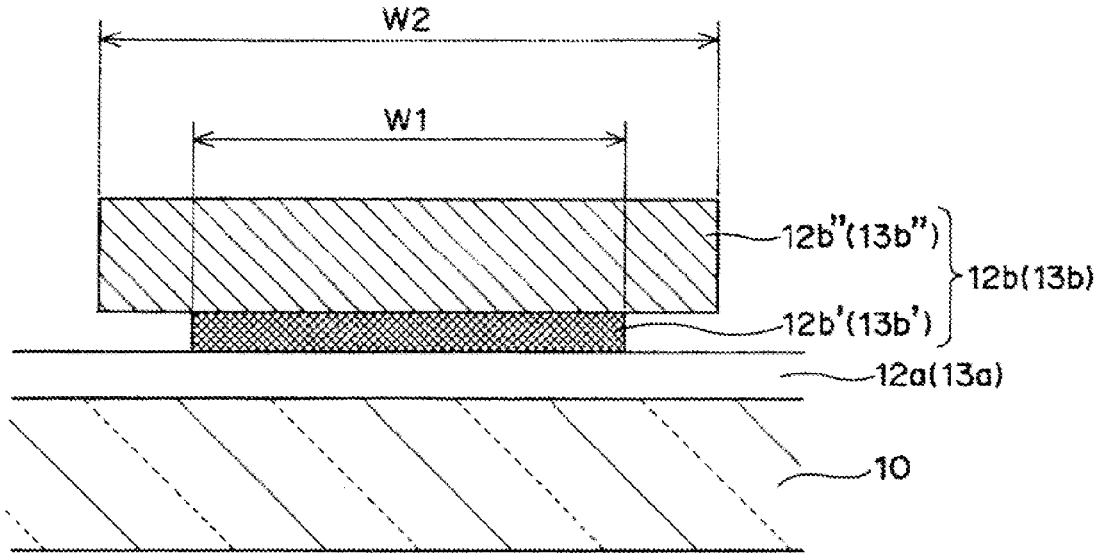
FIG. 7 is a sectional view schematically showing an embodiment of a bus electrode after a development step in JP-A-2008-293867 (prior art).
Figure 8:
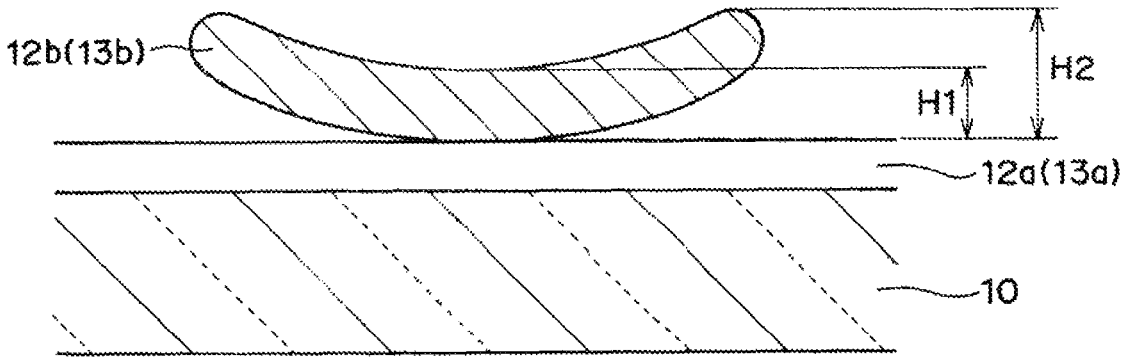
FIG. 8 is a sectional view schematically showing an embodiment of a bus electrode after a calcining step in JP-A-2008-293867 (prior art).
Figure 9:
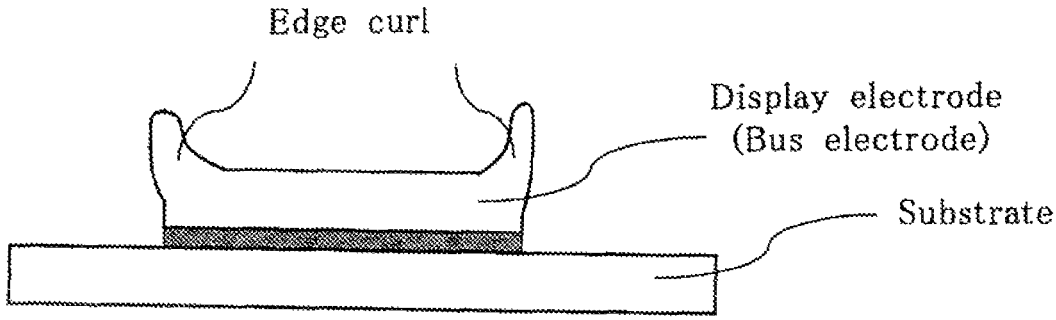
FIG. 9 is a sectional view schematically showing an embodiment of a so-called "edge curl" that occurred in a display electrode, particularly a bus electrode (prior art).

Moreover, by means of a contact-type level-difference meter (manufactured by KLA-Tencor, Ltd., Model SURFACE PRO FILER P-10), an electrode shape of the bus electrode after the PTA treatment was measured. The results are shown in FIG. 6. In FIG. 6, shapes of three bus electrode 3 are shown in which the ordinate axis denotes the height of the bus electrode whereas the abscissas axis denotes the position scanned perpendicularly to a longitudinal direction of the bus electrode. As is apparent from the results shown in FIG. 6, it can be understood that the edge curl disappears in the bus electrode after the PTA treatment.

(Conclusion)

The above results can lead to the following matters:

By subjecting the surface of the bus electrode to the PTA treatment (i.e. local heat treatment), the electrically-conductive particles contained in the surface side region of the bus electrode are melted and subsequently solidified. As a result, the resistance value in the surface side region of the bus electrode become lower than that in the lower side thereof, which facilitates a discharge of the PDP due to much current flow in the bus electrode. Therefore, the PDP with a lower power consumption is realized according to the present invention; and It is possible to eliminate "edge curl" of the display electrode by performance of the PTA treatment (i.e. local heat treatment). As a result, the PDP with a dielectric strength voltage is realized particularly even when the dielectric layer is formed by a sol-gel method.

The PDP obtained by the method of the present invention has not only a lower power consumption, but also high dielectric strength value. Accordingly the PDP is not only suitable for household use and commercial use, but also suitable for use in other various kinds of display devices.

CROSS REFERENCE TO RELATED PATENT APPLICATION

The disclosure of Japanese Patent Application No. 2010-30294 filed Feb. 15, 2010 including specification, drawings and claims is incorporated herein by reference in its entirety.

What is claimed is:

1. A plasma display panel comprising:

a front panel comprising a substrate, an electrode, a dielectric layer and a protective layer, wherein the electrode, the dielectric layer and the protective layer are formed on the substrate of the front panel; and, a rear panel comprising a substrate, an electrode, a dielectric layer and a barrier rib and a phosphor layer, wherein the electrode, the dielectric layer and the barrier rib and the phosphor layer are formed on a substrate of the rear panel;

wherein the front panel and the rear panel are oppositely disposed to each other;

wherein the electrode of the front panel is composed of a transparent electrode and a bus electrode;

wherein the bus electrode comprises a melted-solidified portion obtained by a melting and subsequent solidifying of electrically-conductive particles;

wherein the melted-solidified portion extends from the surface of the bus electrode to a limited depth thereof; and wherein the thickness of the melted-solidified portion is in the range of 0.2 t to 0.7 t where "t" denotes a thickness of the bus electrode.

2. The plasma display panel according to claim 1, wherein the bus electrode has a two-layered structure composed of a black layer and a white layer wherein the black layer is in contact with the transparent electrode and the white layer is provided on the black layer; and wherein the black layer comprises a glass material having a softening temperature of 400° C. to 550° C.

3. A method for producing a plasma display panel comprising a front panel wherein an electrode, a dielectric layer and a protective layer are formed on a substrate of the front panel, the electrode of the front panel being composed of a transparent electrode and a bus electrode, a formation of the bus electrode comprising:

(i) preparing a bus-electrode material which comprises electrically-conductive particles;

(ii) supplying the bus-electrode material onto the transparent electrode formed on the substrate;

(iii) heating the bus-electrode material to form the bus electrode therefrom; and (iv) heating the surface of the bus electrode as a local heat treatment to allow at least one of the electrically-conductive particles contained in the bus electrode to melt, wherein the electrically-conductive particles are contained only to the limited depth range of 0.2 t to 0.7 t from the surface of the bus electrode and are allowed to melt by the step (iv), where "t" denotes a thickness of the bus electrode.

4. The method according to claim 3, wherein a plasma torch, a laser or a flash lamp is used for the local heat treatment of the bus electrode.

* * * * *